US010625267B2

(12) United States Patent
Pallmann et al.

(10) Patent No.: US 10,625,267 B2
(45) Date of Patent: Apr. 21, 2020

(54) DEVICE AND GRINDING TOOL FOR COMMINUTING FEED MATERIAL

(71) Applicant: PALLMANN MASCHINENFABRIK GmbH & Co. KG, Zweibruecken (DE)

(72) Inventors: Hartmut Pallmann, Zweibruecken (DE); Berthold Alles, St. Wendel (DE)

(73) Assignee: Pallmann Maschinenfabrik GmbH & Co. KG, Zweibruecken (DE)

( * ) Notice: Subject to any disclaimer, the term of this patent is extended or adjusted under 35 U.S.C. 154(b) by 839 days.

(21) Appl. No.: 15/182,917

(22) Filed: Jun. 15, 2016

(65) Prior Publication Data

US 2016/0367996 A1 Dec. 22, 2016

(30) Foreign Application Priority Data

Jun. 15, 2015 (DE) ..... 10 2015 007 435

(51) Int. Cl.
*B02C 13/18* (2006.01)
*B02C 13/288* (2006.01)
(Continued)

(52) U.S. Cl.
CPC ..... *B02C 13/288* (2013.01); *B02C 13/14* (2013.01); *B02C 13/18* (2013.01); *B02C 13/28* (2013.01);
(Continued)

(58) Field of Classification Search
CPC ..... B02C 23/10; B02C 23/08; B02C 23/24; B02C 23/28; B02C 23/26; B02C 13/18; B02C 13/26; B02C 15/00; B02C 15/007; B02C 13/288; B02C 13/14; B02C 13/28; B02C 13/2804; B02C 2013/145; B02C 2013/2808
(Continued)

(56) References Cited

U.S. PATENT DOCUMENTS 3,556,420 A * 1/1971 Brown ..... B02C 13/18 241/86
4,747,550 A 5/1988 Jackering
(Continued)

FOREIGN PATENT DOCUMENTS

DE 35 43 370 A1 6/1987
DE 197 23 705 C1 1/1999

*Primary Examiner* — Evan H MacFarlane
*Assistant Examiner* — Nhat Chieu Q Do
(74) *Attorney, Agent, or Firm* — Muncy, Geissler, Olds & Lowe, P.C.

(57) ABSTRACT

A device and a plate-like grinding tool for grinding feed material that has a housing extending along an axis of rotation, in which a rotor rotationally driven about the rotation axis is arranged and includes a plurality of axially parallel grinding tools that are surrounded by a stator with stator tools. The effective edges of the grinding tools are arranged radially spaced from the stator tools by forming a grinding gap extending over an axial length of the grinding gap. The material is fed into the grinding gap on an inlet side and exits from the grinding gap on an outlet side. The axially extending effective edges of the grinding tools are divided in the axial direction into at least two first sections, each with a first radial distance from the rotational axis and into at least one second section with a second radial distance from the axis of rotation.

14 Claims, 5 Drawing Sheets

(51) Int. Cl.
*B02C 13/14* (2006.01)
*B02C 13/28* (2006.01)
*B02C 23/28* (2006.01)

(52) U.S. Cl.
CPC ..... *B02C 13/2804* (2013.01); *B02C 23/28* (2013.01); *B02C 2013/145* (2013.01); *B02C 2013/2808* (2013.01)

(58) Field of Classification Search
USPC ..... 241/188.1, 189.1, 191, 47, 57, 62
See application file for complete search history.

(56) References Cited

U.S. PATENT DOCUMENTS 5,110,059 A * 5/1992 Titmas ..... B02C 18/18
241/190
2006/0013064 A1 * 1/2006 Bucher ..... B01F 7/008
366/303

* cited by examiner

DEVICE AND GRINDING TOOL FOR COMMINUTING FEED MATERIAL

This nonprovisional application claims priority under 35 U.S.C. § 119(a) to German Patent Application No. 10 2015 007 435.0, which was filed in Germany on Jun. 15, 2015, and which is herein incorporated by reference.

BACKGROUND OF THE INVENTION

Field of the Invention

The invention relates to a device for crushing feed material and a grinding tool for use in such a device.

Description of the Background Art

Such devices are known among other things as whirlwind mills for fine grinding and pulverizing of bulk feed material and in particular for grinding heat-sensitive feed. DE 35 43 370 A1, which corresponds to U.S. Pat. No. 4,747,550, discloses such a mill with a cylindrical stator containing a revolving rotor. While the stator extends over the entire axial length of the rotor, the rotor is divided into several grinding steps by arranging axially spaced circular discs. Each grinding step is associated with a plurality of grinding plates which are detachably fastened to the outer circumference of the circular discs. When the rotor is rotating, the grinding plates generate a vortex field with their axially extending edges in which the feed particles are constantly accelerated and deflected. The comminution of the feed material is carried out by acceleration, impact and frictional forces, which the feed particles are subjected to in the vortex field.

A comparatively enhanced mill is described in DE 197 23 705 C1. There, the grinding zone is divided into an inlet-side area where the feed material is first crushed by the mechanical action of the milling strips before it enters the outlet-side region of the grinding zone, where an autogenous comminution takes place in the vortex field of the rotor. In this way, the mill can be adjusted to the specific characteristics of the feed material and the milling process, both in the inlet-side and in the outlet-side milling area by means of design measures, thereby increasing the effectiveness of the mill.

SUMMARY OF THE INVENTION

It is therefore an object of the invention to further develop known devices with a view to a cost-effective crushing operation and consistently high quality of the final product.

In an exemplary embodiment of the invention, the profile of the effective edges of the grinding tools of a rotor are modified in such a way that additional crushing-enhancing effects result. An embodiment is thereby based on the assumption that an edge moving in a gaseous medium produces eddies whose vortex axes are oriented substantially parallel to the edge. In the sphere of influence of the eddies, the individual particles of material are exposed to enormous acceleration forces and changes in direction as well as impact and frictional forces, which perform the shredding process.

The invention now aims to change the vortex field in the peripheral region of the rotor, to which the axially extending effective edges of the grinding tools are set back in one or more sections in the direction of the rotor axis. Thus, in first sections L1, this creates axially extending effective edges with a first radial distance R1 to the rotational axis, and axially extending effective edges in second sections L2 arranged between the first sections L1, with a second radial distance R2 to the rotation axis differing therefrom, wherein the first radial distance R1 is greater than the second radial distance R2. In accordance with an embodiment of the invention, all sections with a lower radial distance as compared to the first partial sections L1 thus belong to the second sections L2, which implies that the second sections L2 can also have different radial distances $R_2$ to each other, so long as they are smaller than the radial distance R1 of the first sections L1 to the rotation axis.

This design approach creates radially extending effective edges which not only extend the length of an effective edge of a grinding tool, but also generate additional vortices with a radially aligned vortex axis. A radially extending effective edge is not only understood to be a right angle between axially and radially extending edges, but in general also an arrangement of the radial edges transverse to the axially extending edges. Due to the inventive profile of the effective edge, each grinding tool thus creates two types of vortices whose vortex axes are transverse to each other, preferably at right angles, and of which the intensity varies in time and space by mutual interference.

During operation of a device according to the invention, the superposition of the differently oriented vortices causes extremely complex turbulent flow conditions in the spaces between two adjacent grinding tools. This considerably increases the efficiency of the grinding process, which initially manifests itself in an unexpectedly high increase in output of an inventive device. The relatively short residence time of the feed material in the grinding area minimizes the heat input to the feed, so that such a device is also suitable for crushing heat-sensitive feed material.

However, the highly effective feed processing also opens up the possibility of supplying the feed to an inventive device in a coarser grain size without the attainable fineness of the comminuted material being negatively affected. An inventive device thus additionally stands out from known devices by a higher degree of comminution.

Due to the fact that an inventive grinding tool generally extends over the entire axial length of the milling zone, all effective edges can be replaced by exchanging a relatively small number of grinding tools. In this way, the tool replacement times when replacing the grinding tools due to wear or when adapting the device to another feed material can be reduced to a minimum, leading to a highly economical overall operation of the inventive device.

The inventive measures provided for an advantageous adaptation and optimization comprise among other things the choice of a suitable number and/or relative length of the first and second sections L1, L2 of the axially extending effective edges relative to the total length L of the grinding tools or the choice of a suitable length ratio between the first sections L1 and second sections L2. The total length of all first sections L1 is preferably 50% to 90% of the total axial length L of a grinding tool, most preferably 60% to 80%, and/or the total length of the first sections L1 and/or the sum of all lengths of the second sections L2 stand in a ratio of 5:1 to 1:1. This means that due to the smaller radial distance to the stator tools, at least half the length of an effective edge of a grinding tool according to the invention is available for intensive interaction with the stator tools, where a large part of the crushing work is performed.

The axial length of each second section L2 of an effective edge of a grinding tool can be 10% to 50% of the total axial length L of the grinding tool, preferably 20% to 40%. This measure limits the axial length of the second section L2 with respect to the total length of the grinding tool, enabling targeted control of the material flow inside the rotor.

Advantageously, an inventive grinding tool can have along its length a maximum of eight second sections L2, preferably two to four second sections $L_2$. Due to the number of second sections L2, the intensity and thus the efficiency of the comminution of material may be influenced, wherein in the peripheral region of the rotor, a vortex field with a mostly uniform crushing effect is produced.

By means of a suitable length of the radially effective edges, the number and thus the effect of the vortices with a radially oriented vortex axis can be adjusted. In an advantageous embodiment of the invention, for this purpose, the radially effective edge can have a maximum length corresponding to the axial length of the adjacent second section L2, which is preferably 30% to 60% of the axial length of the adjacent second section L2. At the same time, this will also influence the course of the material stream in the rotor, since due to the greater radial distance from the stator tools, the feed material flows in a concentrated manner from one chamber to an adjacent chamber between the grinding tools in the areas of the second sections L2. Depending on the type of feed material and the type of material processing, the length of the radially effective edges of a preferred grinding tool is, for example, at least 5 mm, at least 8 mm, at least 10 mm, at least 15 mm or at least 20 mm.

The recessed second sections L2 of the axially effective edges thus result in a material flow within a device according to the invention, in which in the range of these second sections L2, larger particles flow from a chamber formed between two grinding tools adjacent to one another in the rotor, into a subsequent chamber to be shredded there. By contrast, already sufficiently refined particles of material are entrained by the air flow in the leading vortex chamber and are removed from the device. In addition to having a highly efficient comminution process, the additional advantage of this processing mode is that within narrow limits, the comminuted material is very uniform in terms of shape and size of the individual particles of material, so that high requirements in respect of the quality of the final product are met.

The effective edges of the second section L2 or the second sections L2 of two grinding tools adjacent to one another in the rotor can thereby have the same radial distance R2 from the axis of rotation, or also a different radial distance. If, for example, the radial distance R2 of the section L2 leading in the direction of rotation is smaller than that of the following section L2, a greater proportion of the feed material will encounter the subsequent grinding tool and be shredded there. In this way, the flow of material and the intensity of comminution can be controlled.

The same applies to different axial lengths of the second sections L2 of two grinding tools adjacent to one another in the rotor. Here too, at a greater length of the second section L2 of a leading grinding tool, as compared to the smaller length of the second section L2 of the subsequent grinding tool, a greater proportion of the feed material will meet the subsequent grinding tool and be comminuted there.

Alternatively, or cumulative to the measures described above, this effect may also be controlled by the second sections L2 of a grinding tool as compared to the second sections L2 of a grinding tool adjacent to one another in a rotor, having an axial offset V. Thus, the material flow is controlled by a device according to the invention in such a way that the feed material on its way from the inlet side to the outlet side of the rotor successively traverses a plurality of chambers formed in the rotor between the grinding tools. In this way, the chambers each represent one processing stage, which stages are successively traversed by the feed.

If, for example, the feed material is to be kept longer in the region of the grinding tools for intensive shredding, the axial offset V can be made smaller. In this case, it is possible that a grinding tool has a plurality of second sections L2 over its axial length and that the feed material passes through a larger number of chambers. In this sense, the offset V of two second sections L2 adjacent to one another in the rotation direction in respect of their centers can, for example, be at least the sum of the half axial length of the second section L2 of the leading grinding tool and half the axial length of the second section L2 of the subsequent grinding tool, most preferably at least the sum of the axial length of the second section L2 of the leading grinding tool and the axial length of the second section L2 of the subsequent grinding tool.

With a larger axial offset, which, for example, comprises at least 3 times, at least 4 times or at least 5 times the length of a second section L2, proportionately short residence times of the feed material in the region of the grinding tools result, with the advantage of high engine power and low heat input into the feed.

In a uniform axial displacement of all second sections L2, the second sections L2 sit on a number of parallel extending helices around the rotor axis, wherein the pitch of the helical lines determines the measure of the axial offset. To achieve the above advantages during material processing, the helices can extend at an angle $\varepsilon$ between 10 degrees and 50 degrees to the surface lines of the rotor, most preferably at an angle $\varepsilon$ between 20 degrees and 35 degrees.

To exercise either a promoting or retaining effect on the movement of the flow of material, an advantageous embodiment of the invention provides that the effective edges of the grinding tools extend at an angle $\beta$ to the surface lines of the rotor. If the outlet-side effective edge of the grinding tool is inclined in the direction of rotation ($-\beta$), a more retaining effect with longer residence times of the feed material in the region of the grinding tools occurs, while with an opposite inclination ($+\beta$), the product flow is accelerated and thus the length of stay shortened. Suitable angles $\beta$ for this purpose are −5 degrees to +5 degrees relative to a surface line of the rotor, preferably −3 degrees to +3 degrees.

In an embodiment of the invention, it is provided that the effective edge of the inlet-side and/or outlet-side end of a grinding tool can be formed by a third section L3 with a third radial distance R3 from the rotational axis, wherein the first radial distance R1 of the first section L1 is greater than the third radial distance R3. This measure allows for the particles of material in the inlet region and/or outlet region to have a lower axial velocity and, due to the greater residence time, to be distributed over the circumference of the rotor.

In an embodiment, the third radial distance R3 of two grinding tools adjacent to one another in the rotor can vary in size. If a grinding tool leading in the direction of rotation has a third section L3 with a smaller radial distance R3 relative to the radial distance R3 of a third section L3 of a subsequent grinding tool, a greater proportion of the feed material will meet the subsequent grinding tool and be crushed there. In this way, the flow of material and the intensity of comminution can be controlled.

Further scope of applicability of the present invention will become apparent from the detailed description given hereinafter. However, it should be understood that the detailed description and specific examples, while indicating preferred embodiments of the invention, are given by way of illustration only, since various changes, combinations and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
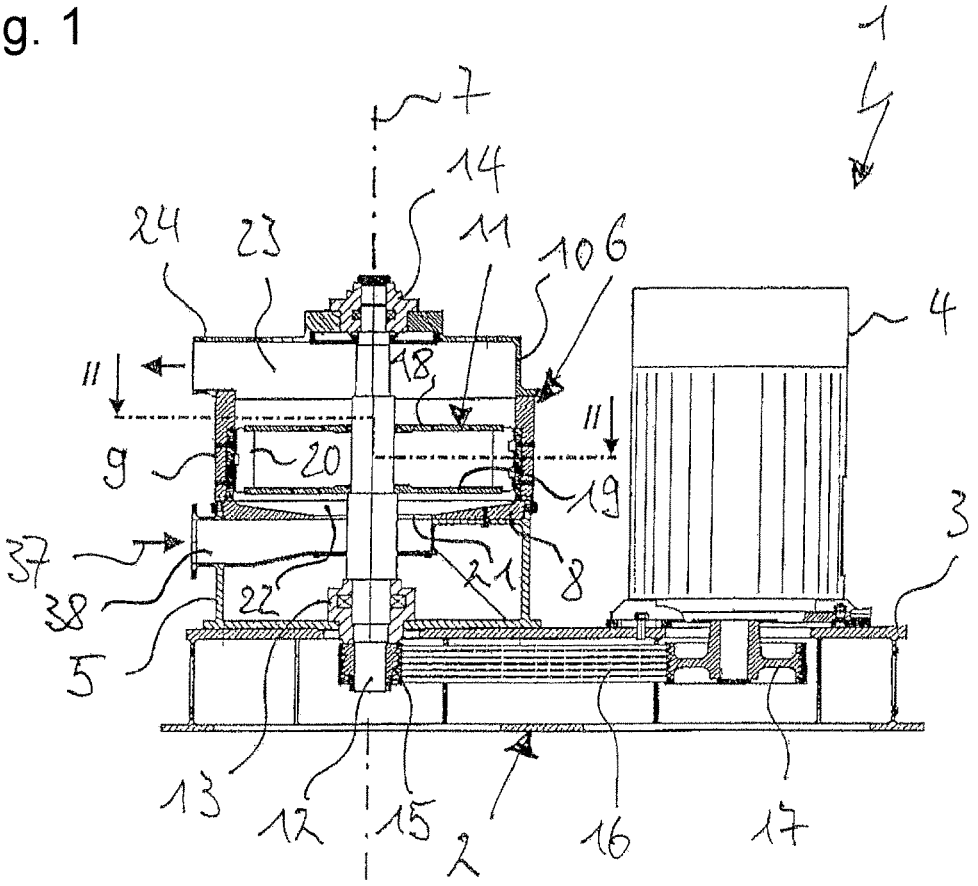
FIG. 1 illustrates a longitudinal section through an inventive device along the line I-I shown in FIG. 2.
Figure 2:
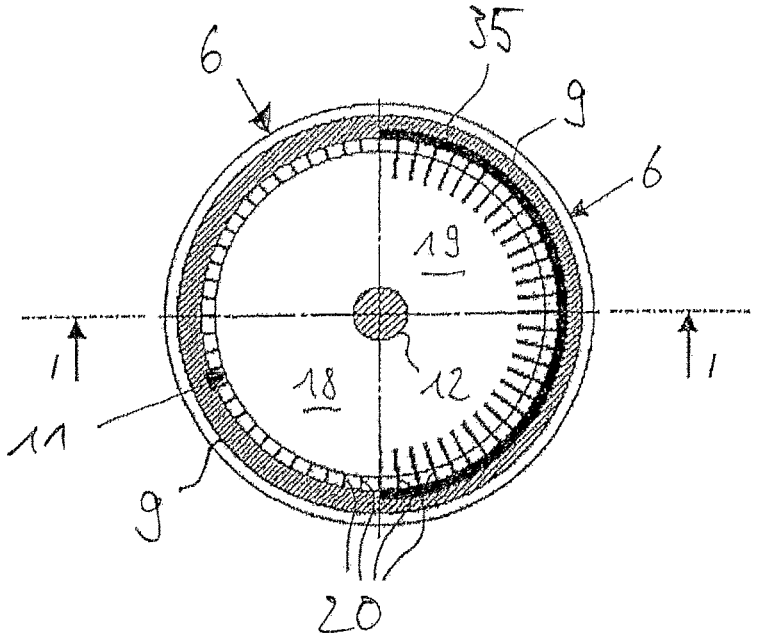
FIG. 2 illustrates a partial section through the device shown in FIG. 1 along its line II-II.
Figure 3:
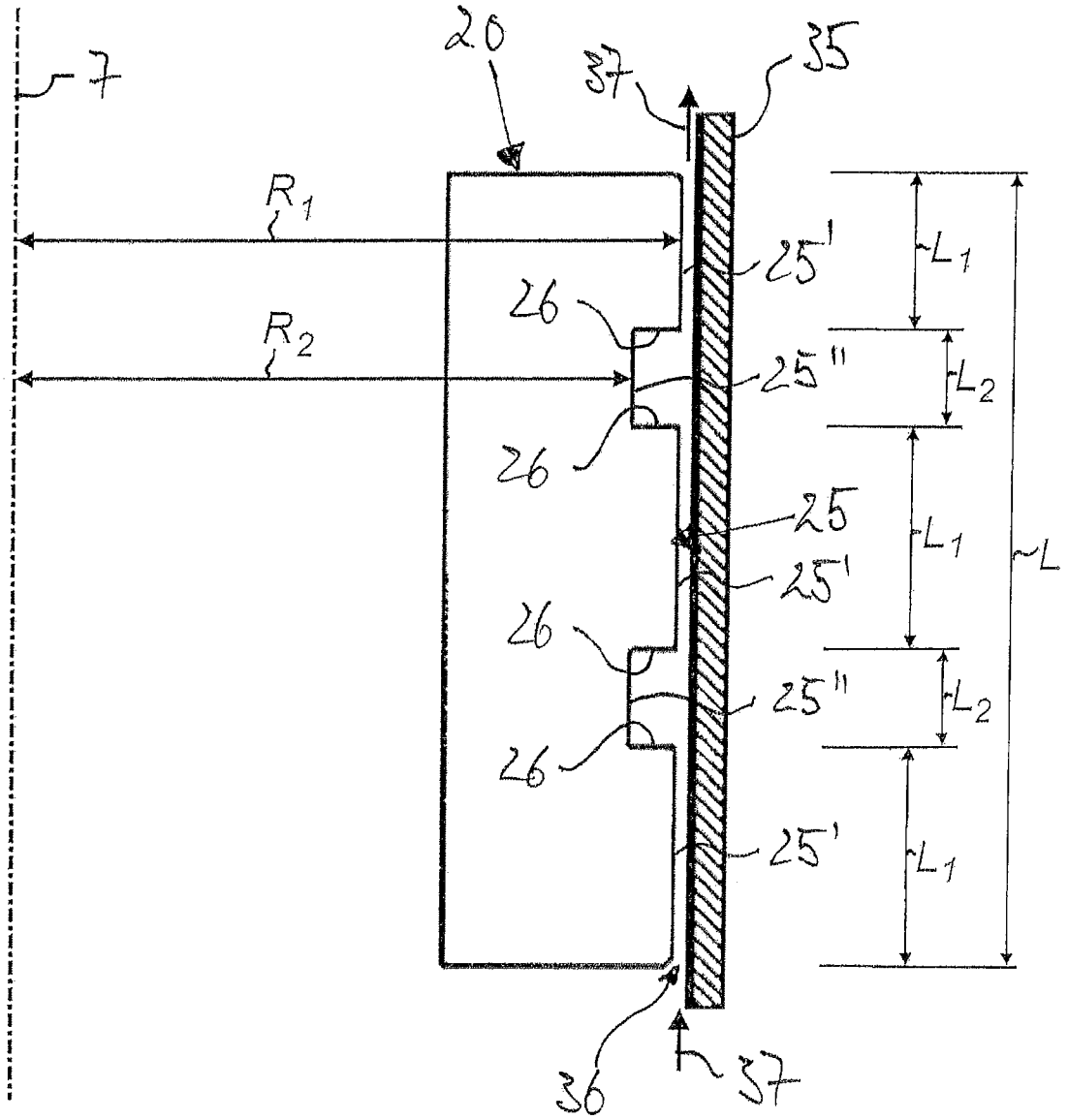
FIG. 3 illustrates a sketched representation of an embodiment of the grinding zone of the device with grinding tools shown in FIG. 1, formed by stator tools and grinding tools, the FIGS. 4*a*-4*d* illustrate views of grinding tools, arranged mutually adjacent in the rotor in an embodiment.

FIGS. 1 to 3 show an embodiment of an inventive device 1 in the form of a whirlwind mill, which is used without limitation for fine and very fine comminution of plastics such as thermosets, thermoplastics and elastomers or for grinding of crystalline materials or agglomerates. The device 1 comprises a platform-like machine base 2, which closes at the top with a horizontal mounting plate 3 on which a rotary drive 4 and a support frame 5 are mounted side by side. A cylindrical housing 6 is firmly connected with the support frame 5, which housing axis oriented perpendicular to the mounting plate 3 bears the reference number 7. The housing 6 is axially divided into an inlet-side housing section 8, a central cylindrical housing section 9, and a discharge-side housing section 10.

A rotor 11 with a drive shaft 12 coaxially to the axis 7 is arranged within the housing. The drive shaft 12 is rotatably supported with its lower end section in a lower bearing 13 and with its opposite end section in an upper bearing 14. The end of the drive shaft 12 extending through the mounting plate 3 carries a multi-grooved pulley 15, which is coupled via drive belts 16 with the multi-grooved pulley 17 of the rotary drive 4.

Within the housing 6, an upper supporting disc 18 is located axially perpendicular to the drive shaft 12 and at an axial distance therefrom, a plane-parallel lower supporting disc 19, which rotate with the drive shaft 12. At its periphery, the supporting discs 18 and 19 have position slots for receiving plate-like grinding tools 20 extending axially parallel, which in this way are distributed annularly over the circumference of the rotor 11 and can move during the operation of an inventive device, for example, with a peripheral speed of between about 100 m/sec and 180 m/sec, depending on the product. The angular spacing of the grinding tools 20 over the circumference of the rotor 11 is uniform and in the present embodiment, is three degrees, but may also be four degrees, five degrees or six degrees or more.

The inlet-side housing section 8 downwardly forms the end-face housing closure and has in the region of the axis 7 a concentric inlet opening 21 for the feed material, said opening surrounding the drive shaft 12 over a sparse radial distance. Over the axial thickness of the inlet-side housing section 8, the inlet opening 21 develops into a flat-tapered expansion that in this way forms a distribution space 22 with the lower vertical supporting disc 19, which tapers radially outwards, thus providing acceleration of the feed material in this area. The outlet-side housing section 10 forms the upper end housing closure, where it houses an annular channel 23 extending concentrically to the axis 7, which merges into a material outlet 24 tangentially emerging from the housing section 10.

The central cylindrical housing section 9 accommodates a stator, for which stator tools 35 are arranged on the housing inner periphery, which as a whole form a baffle web and which include a grinding gap 36 (FIG. 3) with the axially extending effective edges of the plate-like grinding tools 20 of the rotor 11.

The feeding of the device 1 with the feed material 37 takes place via a supply channel 38, through which the feed material 37 reaches the housing interior as a gas-solid mixture via the inlet opening 21, where it is accelerated in the distribution space 22 after being deflected in the radial direction to the grinding gap 36. In the milling gap 36, the feed material 37 helically flows about the axis 7 upwards while it is being crushed. Lastly, the sufficiently refined material passes into the annular channel 23, from where it is removed via the material outlet 24 from the device according to the invention.

In order to influence the grinding effect of the grinding tools 20, the effective edge of the grinding tools 20 has a special profile. As can be seen especially in FIG. 3, each grinding tool 20 possesses an effective edge 25 extending axially parallel to the axis 7, which opposes the stator tools 35 while maintaining a radial milling gap 36. The axially extending effective edge 25 is divided into three first sections L1 in the direction of the axis 7, each having a first radial distance R1 from the axis 7, and two second sections L2, each having a second radial distance R2 from the axis 7. Because the second radial distance R2 is less as compared to the first radial distance R1, there is a radial offset of the effective edge 25" in the area of the second sections L2, relative to the effective edge 25' in the region of the first sections L1 in the direction to the axis 7. The first sections L1 and the second segments L2 are each joined together via radially effective edges 26.

In the present embodiment, the geometrical conditions are selected such, that the sum of the lengths of all the axially extending sections L1 constitutes about 75% of the total axial length L of a grinding tool 20. The ratio of the summed lengths of the first sections L1 to the summed lengths of the second sections L2 is about 3:1. The axial length of a single second section L2 corresponds to about 15% of the total axial length L of a grinding tool 20. The radial length of the edge 26 effective in the radial direction is approximately half as large as the axial length of the subsequent second section $L_2$.

Figure 4A:
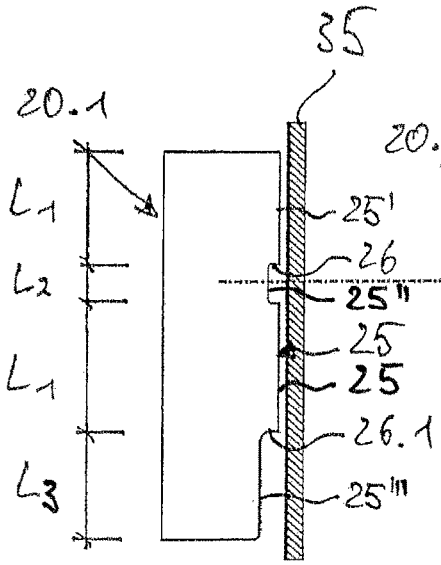
Figure 4B:
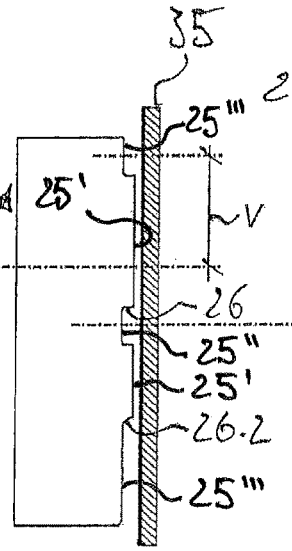
Figure 4C:
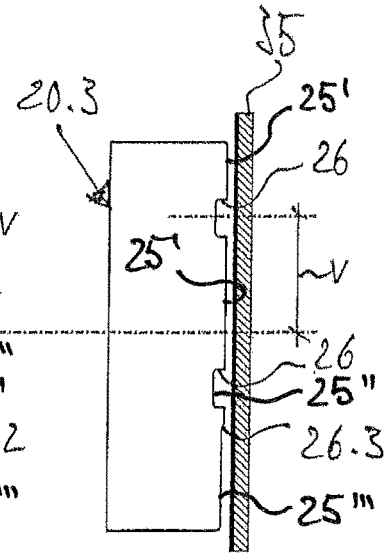

FIGS. 4*a*-*c* show different types of grinding tools 20.1, 20.2, 20.3, adjacent to one another in the rotor 11, as they are generally described in FIG. 3. The arrangement of these different grinding tools 20.1, 20.2, 20.3 in a rotor 11 with a predetermined repetitive sequence is lastly shown in FIG. 4*d*. With respect to the rotational direction R of the rotor 11, the grinding tool 20.1 is the leading grinding tool and the grinding tool 20.2 the subsequent grinding tool.

The grinding tools 20.1, 20.2 and 20.3 according to FIGS. 4*a* through 4*d* have in common that the axially effective edge 25 starts in the inlet-side area with a third section L3. In addition, the grinding tool 20.2 ends as the only one with a third section L3. The axial length of the inlet-side third section L3 is equal in size in all grinding tools 20.1, 20.2 and 20.3. By contrast, the radially effective edge 26.1, 26.2 and 26.3 of the different types of tools adjoining this section L3 is of different lengths. Thus, the radially effective edge 26.1 of the grinding tool 20.1 has the longest length and the radially effective edge 26.3 of the grinding tool 20.3 the shortest length, while the radially effective edge 26.2 has an intermediate length. As a result, the radial distance R3 between the axially extending effective edge 25*m* in the third section L3 to the rotational axis 7 increases respectively from the grinding tool 20.1 or 20.2 to the grinding tool 20.2 or 20.3.

In addition, the grinding tools 20.1, 20.2 and 20.3 have one (FIG. 4*a*) or two (FIGS. 4*b* and 4*c*) second sections L2 in the axial distance to the inlet-side third portion L3, wherein a second section L2 of the grinding tool 20.1 or grinding tool 20.2 has an axial offset V relative to a second section L2 of the adjacent grinding tool 20.2 or grinding tool 20.3. The radially effective edge 26 of all grinding tools 20.1, 20.2 and 20.3 adjoining the second sections L2 all have a uniform length. Also, as shown in FIGS. 4*a-c*, the radially effective edges 26 run transversely to the effective edges 25.

The further embodiment according to FIGS. 5*a* to 5*d* only differs from the one described under FIGS. 4*a* to 4*d* by the higher number of second sections L2. As a result, the number and density of the radially effective edges 26 also increase, so that such a grinding tool 20.1, 20.2, 20.3 is able to more intensively crush the feed material. To avoid repetition, what was stated under FIGS. 4*a* through 4*d* applies accordingly.

Figure 4D:
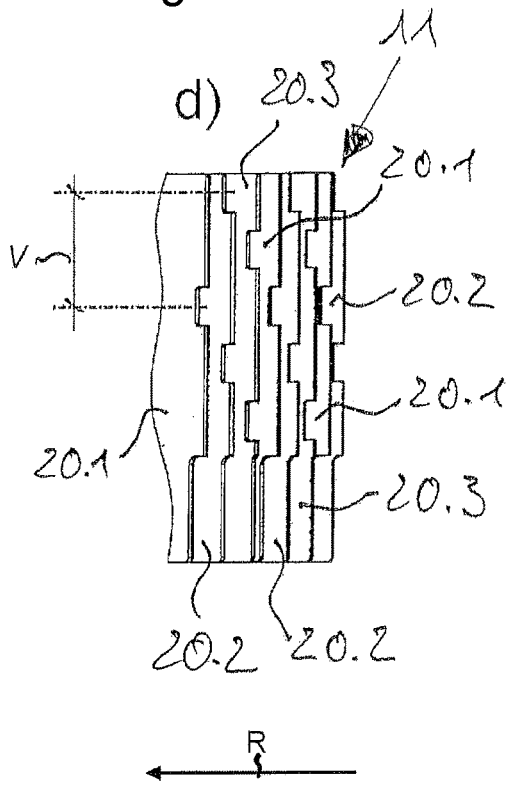
Figure 5A:
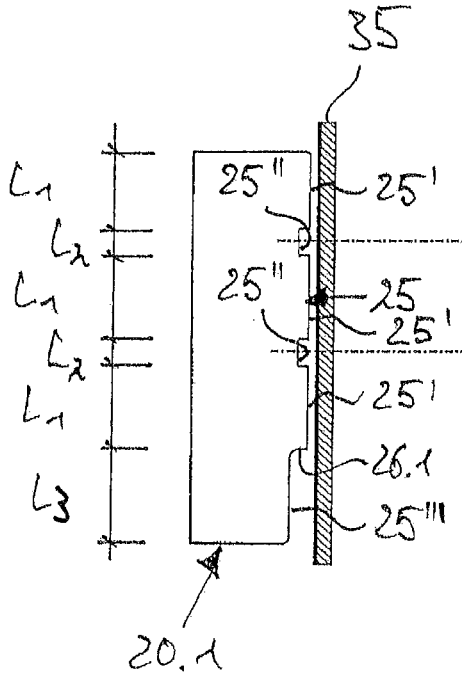
FIGS. 5*a*-5*d* illustrate views of grinding tools, arranged mutually adjacent in the rotor in an embodiment.
Figure 5B:
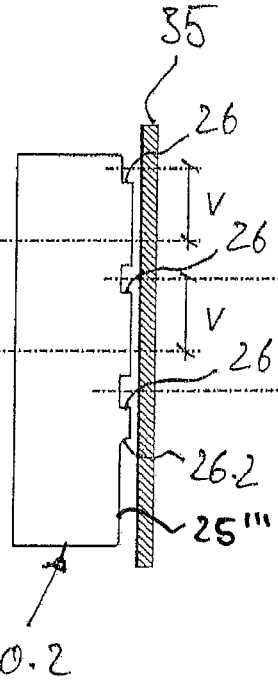
Figure 5C:
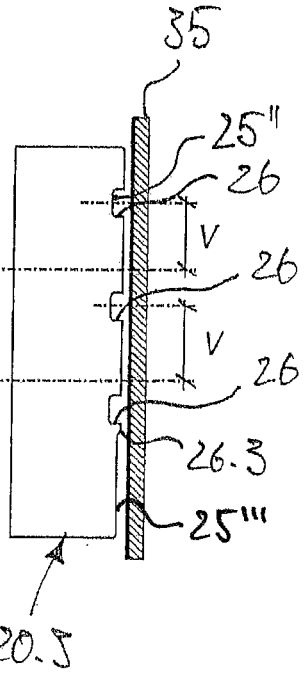
Figure 5D:
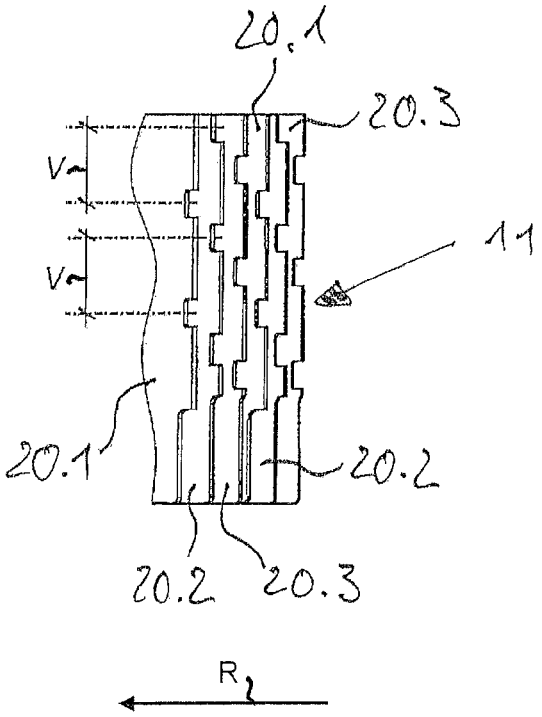
Figure 6:
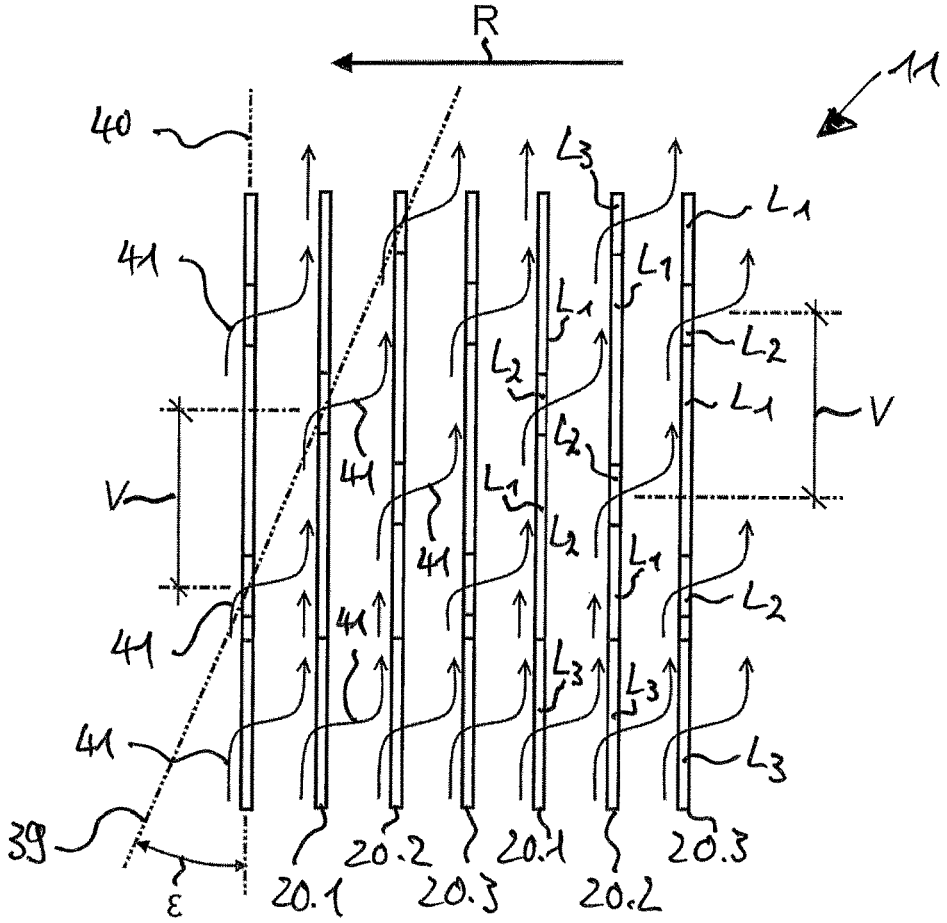
FIG. 6 illustrates a developed view of the rotor portion illustrated in FIG. 4*d*, showing the material flow.

FIG. 6 represents a developed view of the peripheral portion of the rotor 11 shown in FIG. 4*d*. It again provides a recurring sequence of the grinding tools 20.1, 20.2 and 20.3 in the circumferential direction. Two adjacent grinding tools 20.1, 20.2, 20.3 each form an axial flow-through chamber in which the feed material moves from the inlet side to the outlet side. The effective edge of all milling components is divided from the inlet side to the outlet side into an inlet-side third section L3, a first section L1, a second section L2 and a first section L1. The grinding tools 20.2 also end outlet-side with a further third section L3, whose effective edge 25''' is aligned with the effective edge 25'', and the grinding tools 20.3 with a further sequence of a second section L2 and of a subsequent first section L1.

The second segments L2 of two adjacent grinding elements 20.1, 20.2, 20.3 have a uniform axial offset V in the direction toward the outlet side, whereby its arrangement results on lines 39 helically circulating the rotor periphery. The lines 39 enclose with a surface line 40 of the rotor circumference an angle ε a, which in the present embodiment is approximately 45 degrees.

The flow of the feed material in the area of the rotor 11 is symbolized in FIG. 6 by the arrows 41. It is apparent that the feed material, especially in the second longitudinal sections L2, passes from one chamber to the subsequent chamber, thus traveling in a step-like manner through the rotor 11 to the exit on the outlet side.

Figure 7:
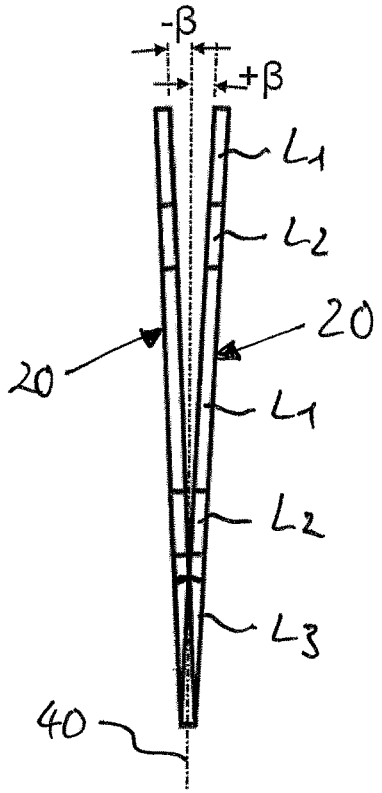
FIG. 7 illustrates a view of two grinding tools with an inclined arrangement with respect to a surface line of the rotor.

Lastly, the subject of FIG. 7 is an embodiment of the invention in which the grinding tools 20 are arranged for controlling the residence time of the feed material in the area of the grinding tools 20, with their effective edge at an angle β to a surface line 40 of the rotor circumference. If the outlet side end of the grinding tool 20 is inclined in the rotational direction R (−β), on impact with the grinding tool 20, the particles of material receive a pulse counter to the general flow of material 41, causing a retaining effect on the flow of material 41. With an opposite inclination (+β), however, the particles of material are accelerated on impact with the grinding tools 20 towards the flow of material 41.

The invention being thus described, it will be obvious that the same may be varied in many ways. Such variations are not to be regarded as a departure from the spirit and scope of the invention, and all such modifications and combinations as would be obvious to one skilled in the art are to be included within the scope of the following claims.

What is claimed is:

1. A device for crushing feed material, the device comprising:

a housing extending along an axis of rotation; and a rotor arranged in the housing, the rotor being rotationally driven about the axis of rotation, the rotor having over its circumference a plurality of axially parallel grinding tools that are surrounded by a stator with stator tools, axially extending effective edges of the grinding tools being arranged a radial distance from the stator tools by forming a grinding gap thereby extending over an axial length of the grinding gap, wherein the feed material is fed to the grinding gap on an inlet side and emerges from the grinding gap on an outlet side, wherein the axially extending effective edges of the grinding tools are divided into at least two first sections in the axial direction, each having a first radial distance from the axis of rotation, and at least one second section having a second radial distance from the axis of rotation, wherein the at least one second section is arranged between the at least two first sections, wherein the first radial distance is greater than the second radial distance, wherein the axially extending effective edges of the at least two first sections and the axially extending effective edge of the at least one second section are connected with each other via essentially radially extending effective edges, wherein a first one of the grinding tools is adjacent to a second one of the grinding tools, the first one of the grinding tools having a different shape than the second one of the grinding tools and the second one of the grinding tools including two of the at least one second section, and wherein the at least one second section of the first one of the grinding tools is axially offset relative to both of the two of the at least one second section of the second one of the grinding tools.

2. The device according to claim 1, wherein a sum of lengths of all first sections of each of the grinding tools is 60% to 80% of a total axial length of each of the grinding tools.

3. The device according to claim 1, wherein a sum of lengths of all first sections of each of the grinding tools and a sum of lengths of all second sections of each of the grinding tools stand at a ratio of 5:1 to 1:1.

4. The device according to claim 1, wherein an axial length of a single second section of each of the grinding tools comprises 20% to 40% of a total axial length of each of the grinding tools.

5. The device according to claim 1, wherein a radial length of the radially extending effective edges of each of the grinding tools is at most as long as an axial length of the at least one second section of each of the grinding tools that adjoins the radially extending effective edges.

6. The device according to claim 1, wherein a radial length of the radially extending effective edges of each of the grinding tools is at least 5 mm.

7. The device according to claim 1, wherein the axial length of the at least one second section of the first one of the grinding tools and the axial length of the two of the at least one second section of the second one of the grinding tools decreases or increases.

8. The device according to claim 1, wherein the second radial distance of the first one of the grinding tools and the second one of the grinding tools decreases or increases.

9. The device according to claim 1, wherein, at an inlet end of each of the grinding tools, one of the axially extending effective edges comprises a third section having a third radial distance from the axis of rotation, and wherein the first radial distance of each of the at least two first sections of each of the grinding tools is greater than the third radial distance of each of the grinding tools.

10. The device according to claim 9, wherein the third radial distance of the first one of the grinding tools and the second one of the grinding tools, decreases or increases.

11. The device according to claim 9, wherein an axial length of the third section is greater than a radial length of the radially extending effective edges.

12. The device according to claim 9, wherein only one of the grinding tools has another third section provided at an outlet end thereof.

13. The device according to claim 1, wherein the axial offset is at least the sum of 50% of the axial length of the at least one second section of the first one of the grinding tools, where the first one of the grinding tools leads in a direction of rotation, and 50% of the axial length of the at least one second section of the second one of the grinding tools, or is at least the sum of the axial length of the at least one second section of the first one of the grinding tools and of the axial length of the at least one second section of the second one of the grinding tools, where the first one of the grinding tools leads in a direction of rotation.

14. The device according to claim 1, wherein by a displacement of the at least one second section of the first one of the grinding tools and the two of at least one second section of the second one of the grinding tools, a helical path is defined which includes an angle with a surface line of the rotor, wherein the angle is between 10 degrees and 50 degrees.

* * * * *